US010155605B2

(12) United States Patent
Morgana et al.

(10) Patent No.: US 10,155,605 B2
(45) Date of Patent: Dec. 18, 2018

(54) METHOD AND SYSTEM TO PROMOTE THE INCORPORATION OF UNUSED SUBSTRATE AREAS INTO ORNAMENTAL PACKAGES

(71) Applicant: Xerox Corporation, Norwalk, CT (US)

(72) Inventors: Stephen C. Morgana, Rochester, NY (US); Reiner Eschbach, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1486 days.

(21) Appl. No.: 13/669,826

(22) Filed: Nov. 6, 2012

(65) Prior Publication Data

US 2014/0129018 A1 May 8, 2014

(51) Int. Cl.
*B65D 5/42* (2006.01)

(52) U.S. Cl.
CPC ..... *B65D 5/425* (2013.01)

(58) Field of Classification Search
None
See application file for complete search history.

(56) References Cited

U.S. PATENT DOCUMENTS

| | | | | |
|---|---|---|---|---|
| 3,596,068 | A * | 7/1971 | Doyle | G06Q 10/043 33/11 |
| 5,353,390 | A | 10/1994 | Harrington | |
| 5,983,538 | A * | 11/1999 | Crowell | 40/124.14 |
| 7,941,465 | B2 | 5/2011 | Gombert et al. | |
| 8,170,706 | B2 | 5/2012 | Gombert et al. | |
| 8,174,720 | B2 | 5/2012 | Gombert et al. | |
| 2008/0020916 | A1 * | 1/2008 | Magnell | 493/65 |
| 2009/0282782 | A1 | 11/2009 | Walker et al. | |

* cited by examiner

*Primary Examiner* — Mohammad Ali
*Assistant Examiner* — Saad M Kabir
(74) *Attorney, Agent, or Firm* — Fox Rothschild LLP

(57) ABSTRACT

A package generation system allows a user to add an ornamental structure to a package flat by receiving a package design file containing data representing package characteristics. The system uses the package design file to identify a two-dimensional layout of the package. The system identifies: (i) a first area of a substrate that will form a two-dimensional flat of a package; (ii) an unused area of the substrate that will not form part of the package; and (iii) an ornamental structure that is attachable to a facet of the package and which fits within a portion of the unused area adjacent to the facet. The system then outputs a representation of the ornamental structure to a user. Examples of ornamental structures include a ribbon, a detachable coupon, or an ornamental face. The system may create the package after the user selects an offered ornamental structure.

18 Claims, 8 Drawing Sheets

METHOD AND SYSTEM TO PROMOTE THE INCORPORATION OF UNUSED SUBSTRATE AREAS INTO ORNAMENTAL PACKAGES

BACKGROUND

When creating a three-dimensional package, graphics may be printed on a two-dimensional substrate, and a set of cut lines and crease lines will be imparted upon the substrate to yield a package flat that may be folded into a three-dimensional package. Because the package is cut from a substrate, the unused substrate represents a waste product that cannot easily be re-used in a package generation system. Although some manufacturers may begin with a substrate that having has dimensions that are similar to that of the design of the package flat, this is not always possible in the context of personalized packaging, where a particular package design may have a run length as small as one package. To reduce the cost associated with purchasing more substrate material than is needed for a package, and to promote waste reduction, package generation facilities seek more efficient methods and systems for using substrates in package generation.

This document describes systems and methods that present solutions to the problems discussed above, and which may also provide additional benefits.

SUMMARY

In an embodiment, a system allows a user to add an ornamental structure to a package flat by receiving a package design file containing data representing a set of facets and a set of dimensions for a package. The system uses the package design file to identify a two-dimensional layout of the package. The system identifies: (i) a first area of a substrate to be used to form a two-dimensional flat of a package; (ii) an unused area of the substrate that will not form part of the package; and (iii) an ornamental structure that is attachable to a facet of the package and which fits within a portion of the unused area adjacent to the facet. The system then outputs a representation of the ornamental structure to a user. Examples of ornamental structures include a ribbon, a detachable coupon, or an ornamental face.

Optionally, the system also receives, via a user interface, a user selection of the ornamental structure. It then updates the package design file to include data that adds the ornamental structure to the package.

Optionally, the system also determines that one or more characteristics of the package, the ornamental structure, or the substrate satisfy one or more criteria for automatic addition to the package. It may then automatically, without any requirement for user input, update the package design file to include data that adds the ornamental structure to the package.

Optionally, the system may access a data set of available substrates; identify, from the data set, the smallest substrate on which the two-dimensional layout will fit; and select the identified substrate as the substrate from which the package will be cut.

Optionally, when identifying the ornamental structure, the system may access a data set of candidate ornamental structures, wherein each of the candidate ornamental structures comprises one or more requirements. For each candidate ornamental structure, the system may determine whether a characteristic of the unused area satisfies the one or more requirements, and only identify a candidate ornamental structure as the identified ornamental structure if the characteristic satisfies the one or more requirements. The one or more requirements may include a size requirement, and the characteristic may include a dimension that corresponds to the size requirement. The system may also dynamically define a dimension of the ornamental structure based on the dimension of the unused area.

Optionally, when identifying the ornamental structure, the system may access a data set of candidate ornamental structures, wherein each of the candidate ornamental structures comprises one or more requirements. For each candidate ornamental structure, the system may determine whether a characteristic of the package satisfies the one or more requirements, and only identify a candidate ornamental structure as the identified ornamental structure if the characteristic satisfies the one or more requirements.

Any or all of the items listed above may be implemented by a package definition system that includes a data storage facility, a processor, and a computer-readable medium containing programming instructions that, when executed, instruct the processor to perform various functions. The package generation device may apply a rule set to the package design file to generate the two-dimensional flat comprising the package with the ornamental structure. Optionally, the system also may include a user interface and/or a package generation device.

DETAILED DESCRIPTION

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" means "including, but not limited to."

As used in this document, the term "multi-functional device" refers to a machine or group of machines comprising hardware and associated software for printing, copying, facsimile transmitting or receiving, scanning, or performing other actions on document-based data. A "print device" is a device that performs printing based on digital data, or a multi-functional device in which one of the functions is printing based on digital data. A "package generation system" is a machine or group of machines that combines the features of a print device with one or more tools for imparting a cut, crease, and/or perforation on a printed substrate so that the substrate may be folded into a three-dimensional package.

Package production may be performed by a package generation system that is capable of performing printing operations on, and applying creases and cuts to, a substrate. The system also may perform other actions such as coating and/or stacking the substrate. Examples of automated package production system include those in the iGen™ series of digital production printing presses, available from XEROX Corporation, in connection with the corresponding finishing devices. Other systems may include smaller printing devices, such as a XEROX DocuColor 250, or a digital cutter as offered by a variety of manufacturers. In some embodiments, the substrate may be thicker than ordinary paper. For example, the substrate may be cardboard, cardstock, or another material that will provide a self-supporting three-dimensional structure when folded into a package.

One aspect in the creation of a package is that the printing device operates on a two dimensional sheet or "flat." The actual three-dimensional shape of the package is subsequently created through folding and connecting of the facets that make up the flat. Here it is understood that any fold will create a three-dimensional structure or shape in the language of this application. This imposes a variety of restrictions on the structure both in its two dimensional form, as well as in its three dimensional form. The substrate is typically a paper material, such as cardstock, cardboard, or paper having sufficient thickness to provide structural support when folded into a three-dimensional shape.

Figure 1:
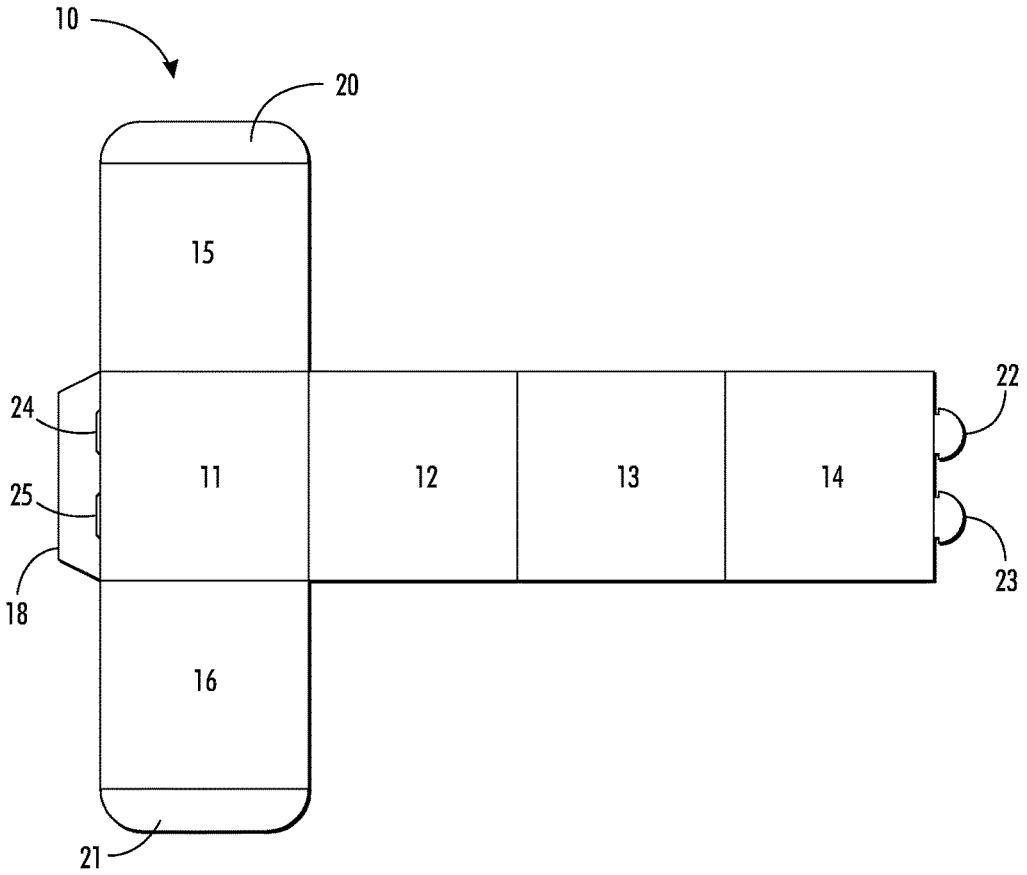
FIG. 1 depicts an example of a two-dimensional package flat.

FIG. 1 shows an example of a package flat 10 that may be formed into a three-dimensional package. This package flat 10, in this case a rectangular box, includes a variety of faces 11-16. Faces 11-14 may be considered sides, while faces 15 and 16 may be considered to be the top and bottom lids of the package. Each of the faces may be considered to be an exterior-facing facet, or a structural element of the final package. Facets also may include various functional elements that provide a connecting or other structural function for other elements of the package. Functional elements may include folds, lids, lips, tabs, flaps, receptacles, or other structures that either extend into or are received by a face or a corresponding functional element. Examples shown in FIG. 1 include flaps 20 and 21, along with locking tabs 22 and 23 and a corresponding lip 18 with slots 24 and 25 that receive the tabs when the package is folded.

In the current system, the system may receive a template or other data that contains the design details for a package flat. In this document, such a template or other data may be referred to as a "package design." The details of the package design will include exterior cut lines that represent the outline of the two-dimensional package flat. When the system receives a package design, it may access a data set of available substrate sizes to select a size that is suitable for the package flat. The system may do this by selecting, from the available substrate sizes, the substrate having the smallest area on which the full package may be cut. This may be done using any suitable method, such as by comparing the outer dimensions of the package design with those of each available substrate, or by any other process.

Figure 2:
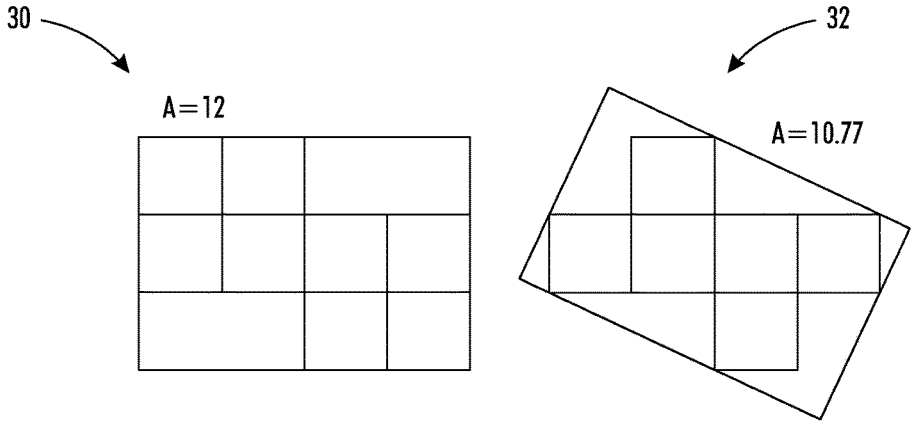
FIG. 2 PRIOR ART
FIG. 2 depicts the application of a package design to two different sizes of substrates.

An example of a prior art substrate selection process is shown in FIG. 2, where the system first applies the package to a substrate 30 having a width measurement and a height measurement equal to or greater than those of the package design (in this case, 3 units high by 4 units high). As used in this context, the terms "width" and "height" are arbitrary terms that refer to two lateral dimensions that are perpendicular to each other. In addition, in FIG. 2 for simplicity only the faces of the package are shown; in practice, the package may also have functional elements that must be considered in the lateral dimension determination. In this example, the substrate 30 has an overall area of 12 square units. The system may then proceed to determine which smaller substrates are available that may fit the package, and identify the smallest such available substrate. For example, the package flat also may fit on a second substrate 32 having an area of 10.77 units if the package flat is oriented on the second substrate 32 in the manner illustrated in FIG. 2.

Despite the efforts to reduce waste by selecting a small substrate, in practice most, if not all, substrates will have an unused area as is illustrated by substrate 32 of FIG. 2. In this document, an "unused substrate area" refers to as an area of the substrate that will not form part of the final package if the package design were cut from the substrate without the addition of one or more ornamental features as described below.

This problem may be magnified if a package is created at a short runlength, as would be the case using a dynamic package definition system. Additionally, in many cases the substrate size is limited to a few known sizes since multiple different structures would be generated in a preferably non-interactive mode, requiring the use of standardized substrates. Without loss of generality we will describe the case of a single substrate size in the following sections of this description. The novel problem associated with very short run structures—down to a runlength of one—is that classical substrate optimization is only applicable in a small subset of shapes where a flat might either fit or not fit in a given substrate. In the other case, noticeable unused substrate area exists. It is the intention of this description to define a way of optimizing the use of this previously unused substrate area.

Figure 3:
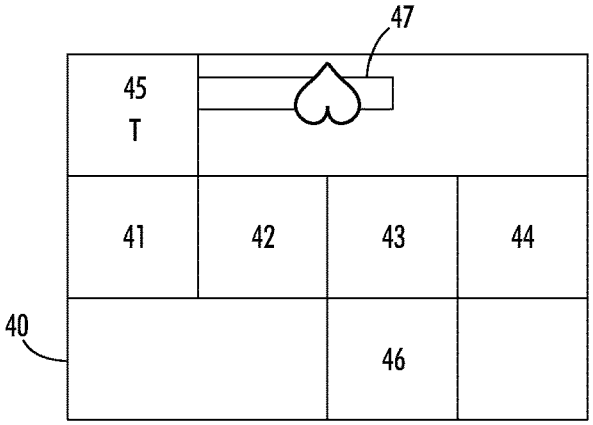
FIG. 3 illustrates an example of a package design applied to a substrate with an ornamental structure.

In one embodiment, the system also may include a data set of designs for ornamental structures that may be added to a dynamic package design. An ornamental structure is a decorative or content-carrying structure that is attached to one or more facets of the package and which is not required to support the finished package when folded into its three-dimensional form. An example is shown in FIG. 3, which shows a substrate 40 that is used to form a package having four side faces 41-44, a top face 45 and a bottom face 46. An ornamental ribbon with heart structure 47 is attached to top face 45. Many other ornamental structures may be available, such a ribbons, bows, hearts, stars, and other graphic elements. Ornamental structures also may include extra, non-structural flaps onto which content is printed. The content may be a coupon, a photo or other image, a personalized message, or other text and/or graphics. In this context, the possible size and location of the ornamental structure may be dynamically determined.

The system may apply one or more rules to determine where an ornamental structure may be attached to the substrate. For example, a rule set may require that the ornamental structure be attached to a facet that will be used as the top lid of the package, as shown in the example of FIG. 3. Other rules may require that the ornamental features be attached to a different facet, such as a side facet or a bottom facet. Such rules may be part of the package template or the ornamental structure data file. In some embodiments, the rules may vary depending on one or more characteristics of the package design, such as whether the package is of a particular size, minimum size, maximum size, shape, or made of a particular type of substrate material. When the system identifies an ornamental structure that may be used, it will apply the rules as described above to determine an attachment location and one or more dimensions for the ornamental structure.

A rule set also may consider one or more characteristics of the ornamental structure before determining whether it may be attached to the package, and if so where. For example, in the case of the ribbon-and-heart ornamental structure 47 of FIG. 3, the rule set may require: (i) that the structure be attached to an edge of a lid 45; (ii) that the edge not be an edge on which a functional element such as a flap or tab is attached; and (iii) that the available unused substrate area extend from the lid 45 at a threshold minimum distance, such as a distance that is at least 1.5 times the width of the lid 45 itself. The rules set also may dynamically define one or more dimensions of the ornamental structures as a function of one or more characteristics of a facet or facets and/or one or more characteristics of the unused paper area. For example, the system may define the ornamental structure to have a width that is at least 1.5 times the width of the lid, and up to 2.5 times the length of the lid, depending on the corresponding dimension of the unused paper area. This may allow the ornamental structure to take maximum advantage of the unused paper area while still having dimensions that are aesthetically appropriate for the overall package.

Figure 4:
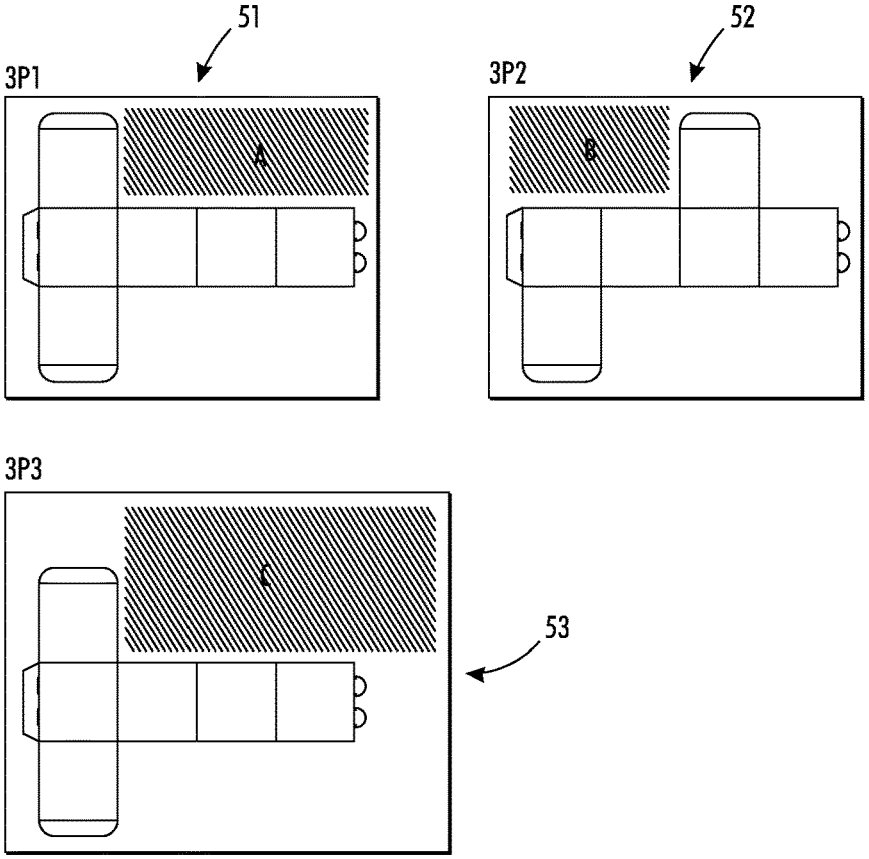
FIG. 4 illustrates several variations of unused areas of a substrate.

FIG. 4 indicates an example of the dynamic nature of the ornamental structure in the context of short runlength packaging. In FIG. 4, three package flats 51, 52, 53 that may be used to form a package of identical shape and size are shown. Substrate 51 indicates the analogous scenario to FIG. 3 indicating the possible area for ornamental structure by A. In substrate 52, the same size package was chosen to have a different lid structure and thus the area for ornamental facets has changed to the one indicated B. In substrate 53, the size of the media has changed and the area available for the ornamental structure is indicated by C. The determination may be performed dynamically in the design process for a short run structure like in a package definition system such as the one described in co-pending U.S. patent application Ser. No. 13/563,071, filed Jul. 31, 2012, the disclosure of which is hereby incorporated by reference in its entirety.

Figure 5:
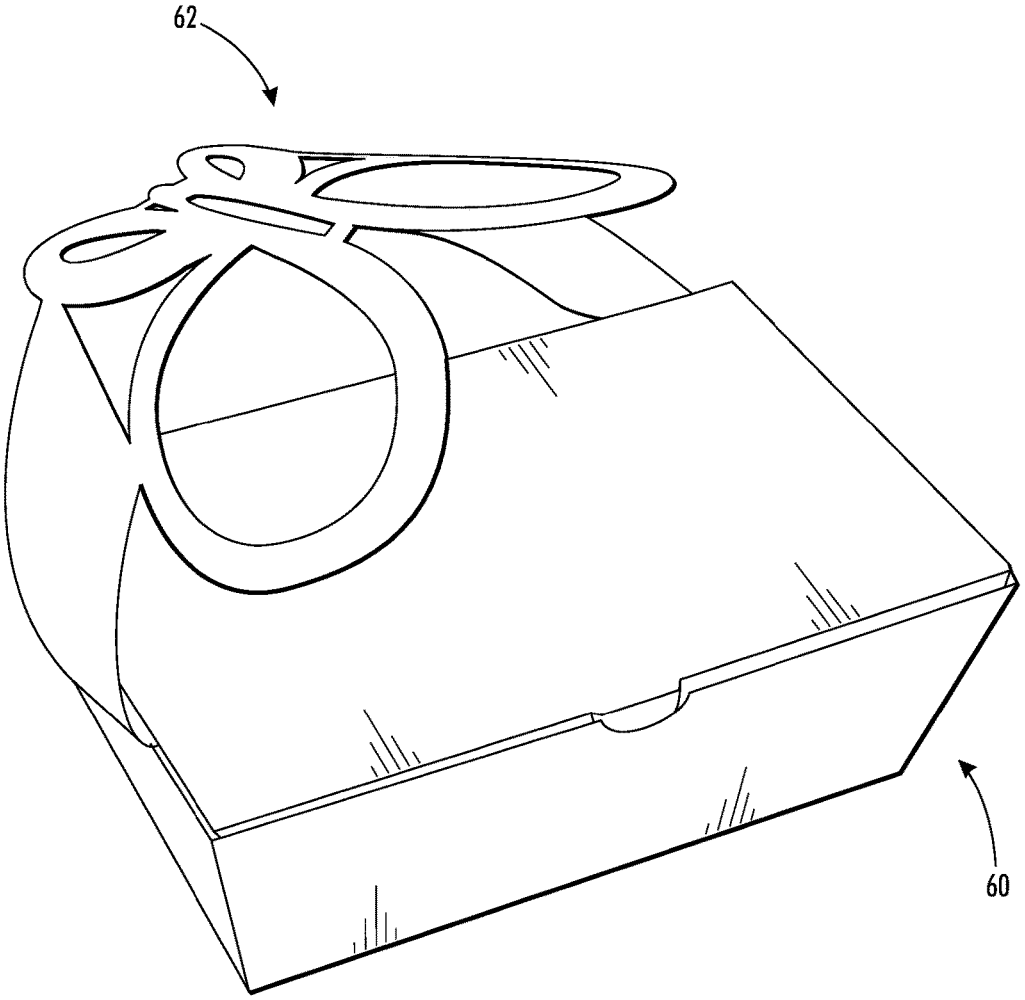
FIG. 5 illustrates an example of a three-dimensional package with an ornamental structure.

FIG. 5 illustrates an example of a package 60 containing an ornamental structure 62 in its assembled stage. In this example, the ornamental structure is a ribbon having an attached cut-out in the shape of a butterfly. The ribbon is attached to the lid of the package and is purely ornamental—i.e., clearly not required to provide supporting structure for the rectangular base package.

In some embodiments, the system may include a user interface that offers a user a set of applicable ornamental structures for a package after it performs the process described above. For example, when it receives a package design, selects a substrate, and identifies one or more ornamental structures that are suitable for the package and which will fit on the substrate, it may offer the identified ornamental structures to a user via a display, an audio output, a printout, or another data delivery device. Optionally, the system may output a cost for any or all of the ornamental structures. The prices may vary, with some or all being free, and others being scaled based on defined criteria such as type of ornament, type of substrate, a user account level; or any other criteria. The user may select one or more of the offered ornamental structures, and the system may modify the package design to include the ornamental structure before creating the package.

Figure 6:
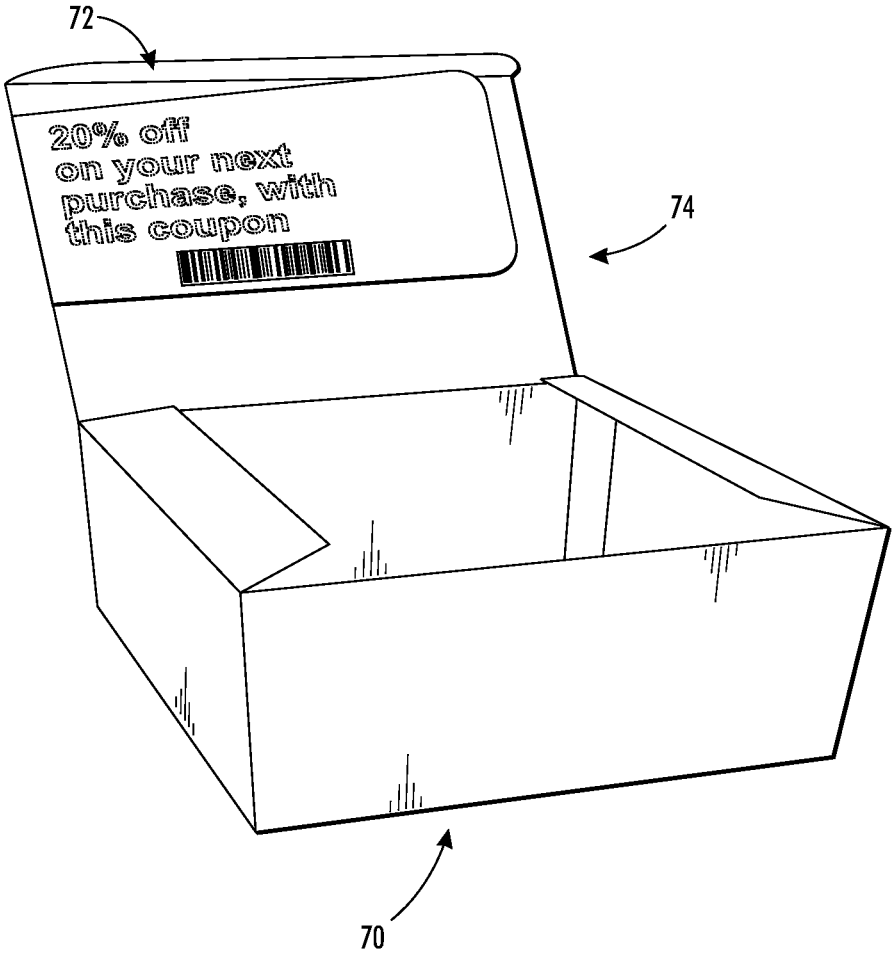
FIG. 6 illustrates an example of a three-dimensional package with an alternate ornamental structure.

In some embodiments, depending on the rule set, the system may automatically revise the package design to include one or more ornamental structures. For example, if the package is a box having a lid of a threshold minimum size (where size may be determined by any lateral dimension, by area, or both), it may automatically attach a content-carrying flap, such as a coupon, to the lid. The rule set may define the coupon as an ornamental structure that is attached to an edge of the lid having no other functional element. The rule set also may define the coupon as being attached to the lid via a perforation cut so that it may be detached from the package by a user at the line of perforation. Thus, the coupon may fold under the lid and become visible to the user when the user opens the lid of the package. The rule set also may define one or more dimensions of the coupon based on predetermined dimensions, or as a function of one or more dimensions of the list. An example is shown in FIG. 6, where the box 70 is shown with a detachable coupon 72 appearing under the lid 74. The coupon 72 has a width that is nearly the same as, but slightly (i.e., less than 5%) smaller than, the width of the lid 74.

Figure 7:
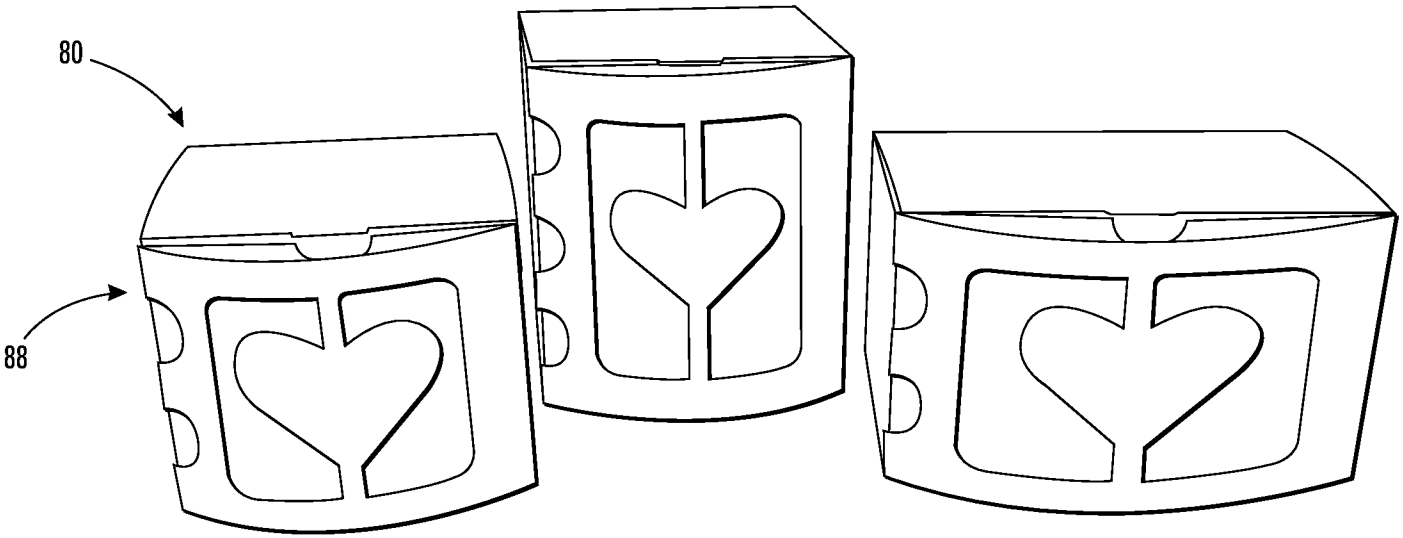
FIG. 7 illustrates an example of a three-dimensional package with an ornamental face.
Figure 8:
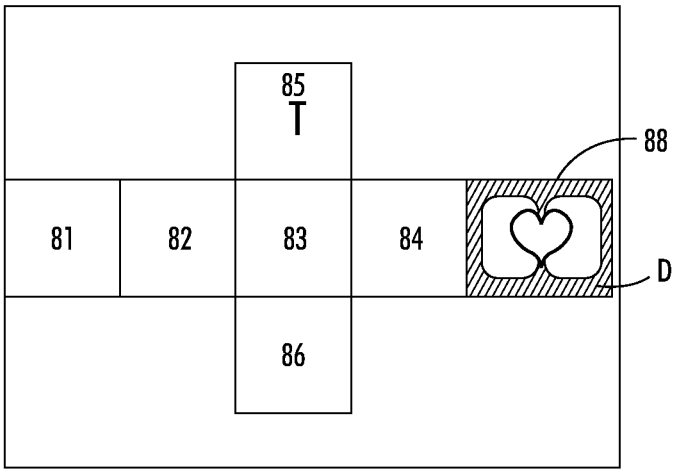
FIG. 8 illustrates the example of FIG. 7 as a package design applied to a substrate with the ornamental face.

In some embodiments, if a substrate has an unused area that is (i) adjacent to a face, and (ii) extends away from the face with a width that is at least equal to the width of the face, the system may offer the user an ornamental structure that is an "ornamental face". As used in this document, an ornamental face is a structure that is attached to a face, that has a width that is at least as large as (and typically larger than) that of the attached face, and which includes a design element such as a cut-out or an embossment. An example of an ornamental face is shown in FIG. 7, where the ornamental face 88 is attached to box 80. FIG. 8 shows a conceptual creation of the box 80 from FIG. 7. In a first step the base two-dimensional flat, with side faces 81-84, top face 85 and bottom face 86 is mapped on a substrate. In this mapping an un-used area is determined, indicated D. For this unused area, multiple ornament options do exist, including the option of an ornamental face. Ornamental face 88 is subsequently attached to side face 84 and has one lateral dimension (e.g., width) that is larger than that of side face 84 so that when the box is formed as shown in FIG. 7, ornamental face 88 extends outward from side face 84. The other lateral dimension (e.g., height) of ornamental face 88 may be less than or equal to that of its corresponding side face 84. Note that the ornamental face 88 can be considered to consist of two dynamic components, the first being the actual face where the size and shape information is directly derived from the data of faces 81-86 plus a secondary dynamic component where the shape of the heart is derived from the size of the window in 88, limiting operations to a homogeneous scaling.

Figure 9:
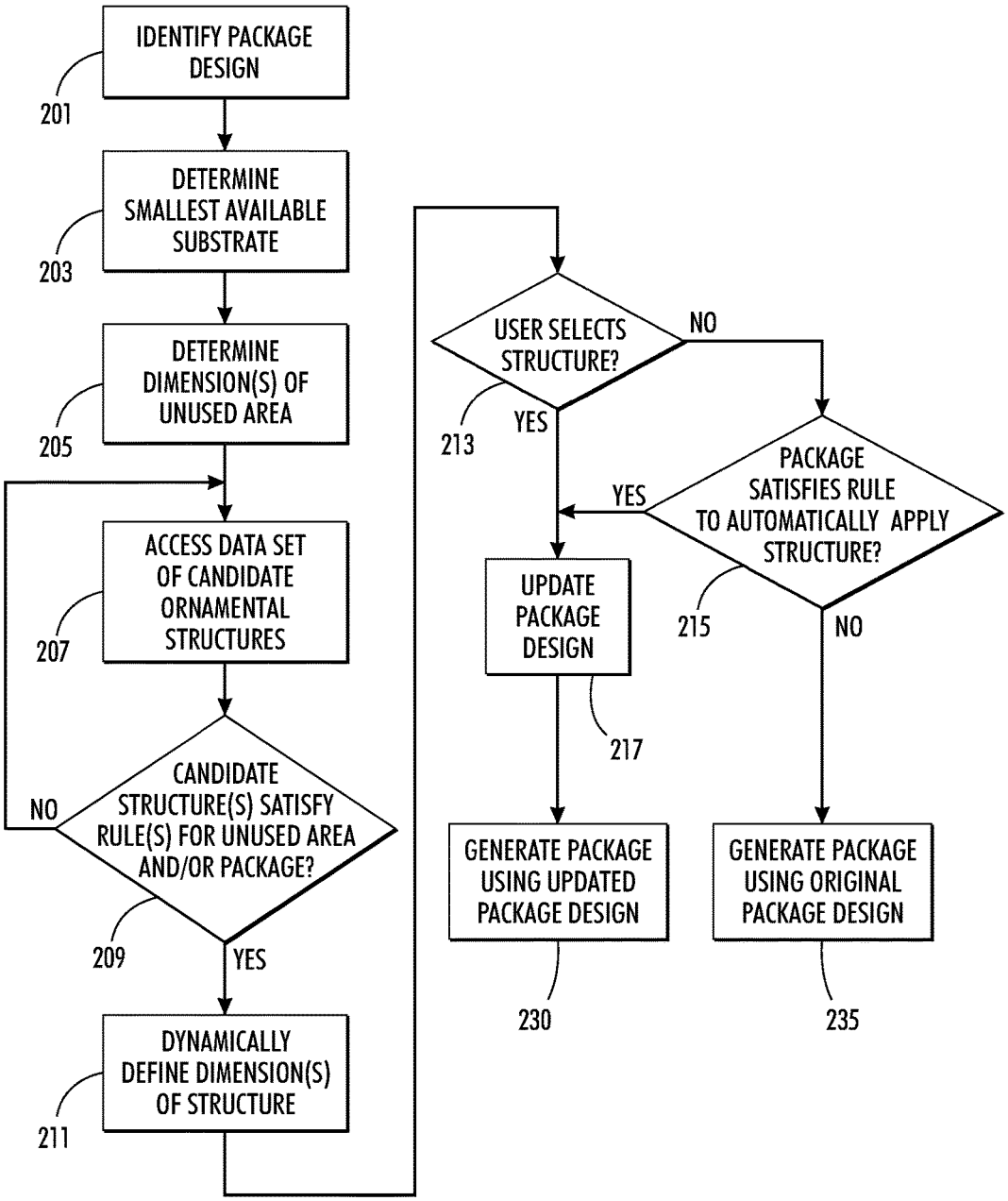
FIG. 9 is a flowchart describing various elements of a process of generating a package having an ornamental structure.

FIG. 9 illustrates a process by which the system may generate a package design incorporating one or more ornamental structures The system may include a user interface, such as a touch-screen display, keyboard, mouse, and/or other equipment that accepts user input and generates or receives a structural representation of the three-dimensional package. After the system identifies a package design 201 based on user selection, structural parameters, receipt of a data file or another process, the system may access a data store containing dimensional data for a set of substrates that are available to the package generation system. The system may determine the smallest substrate that is available to fit the package 203, and then it may determine dimensions of one or more unused areas of the substrate 205. The system may then access a data storage facility containing data for multiple candidate ornamental structures 207, and it may apply one or more rules as described above to select one or more candidate structures that are suitable for the unused substrate area because the candidate structures satisfy the rule or rules 209. If the candidate object is one which has a variable size or shape, the system may apply the rule set and the unused substrate or package data to define the dimensions of the candidate object 211.

The system may then output the candidate ornamental structure or structures to a user. This may be done by presenting the user with a set of candidate ornamental structures in list, graphic or other format to the user. If the user selects the structure 213, the system may update the package design and present the user with a visual, audio and/or text description of the selected candidate structure 217. Or, if the package satisfies a rule for automatic application of an ornamental structure 215 (as in the case of a box to which a coupon will be applied), the system may automatically update the package design and present the user with a visual, audio and/or text description of the updated design with the ornamental structure 217. The system may then generate the package using either the updated design 230 or the original design 235 depending on whether an ornamental structure was selected and/or applied.

Figure 10:
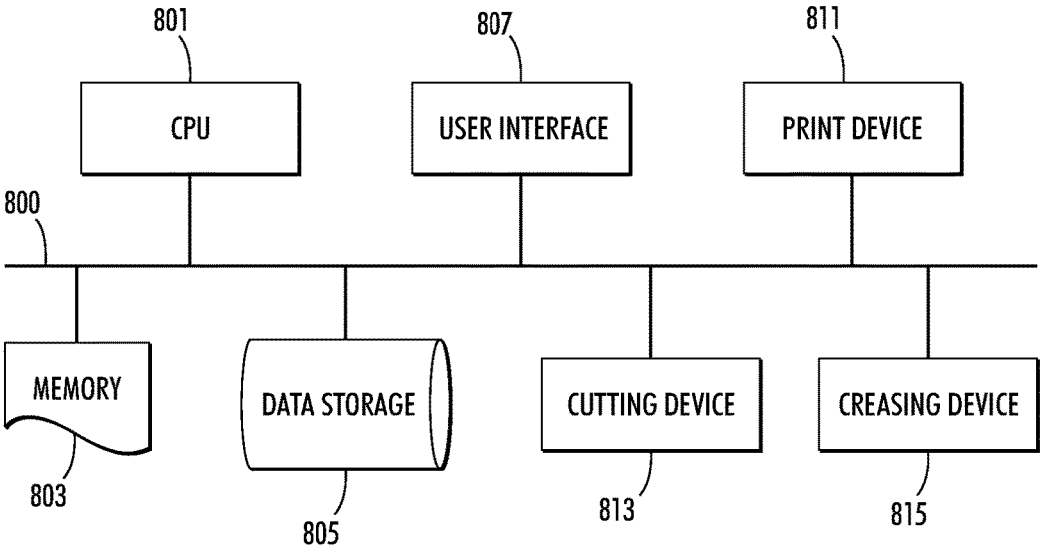
FIG. 10 is a block diagram showing various equipment that may be used to implement various embodiments of the processes described in this document.

FIG. 10 depicts a block diagram of hardware and/or electronics that may make up a package definition and/or production system. One or more communications lines 800 such as a bus or network interconnect the illustrated components and allow data and/or signals to flow between the components. Central processing unit (CPU) 801 is a processor that performs calculations and logic operations required to execute a program. Any number of processors may be available, and they may access a tangible, computer-readable memory device 803 containing programming instructions, along with a data storage facility 805 such as a database that stores the package generation templates and/or rule sets.

A user interface 807 provides output to, and receives input from, a user. The user interface may include a display, audio output, a printer, or another element that provides information to a user. The user interface 807 also may include a touch-sensitive component, microphone, audio port, keyboard, mouse, touch pad, or other input mechanism that is capable of receiving user input.

The system also may include a package generation device, which may include some or all of the following elements: a print device 811, a knife or other cutting device 813, and a roller or other device 815 capable of imparting a crease in a substrate.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A method, comprising:

by a processor:

receiving a package design file containing data representing a plurality of facets and a plurality of dimensions for a package;

identifying, from the package design file, a two-dimensional layout of the package;

identifying a first area of a substrate to be used to form a two-dimensional flat of the package;

identifying an unused area of the substrate that will not form part of the package;

applying one or more rules to identify an ornamental structure that is attachable to a facet of the package and which fits within a portion of the unused area adjacent to the facet; and outputting a representation of the ornamental structure to a user.

2. The method of claim 1, further comprising:

receiving, via a user interface, a user selection of the ornamental structure; and updating the package design file to include data that adds the ornamental structure to the package.

3. The method of claim 1, further comprising:

determining that one or more characteristics of the package, the ornamental structure, or the substrate satisfy one or more criteria for automatic addition to the package; and automatically, without any requirement for user input, updating the package design file to include data that adds the ornamental structure to the package.

4. The method of claim 1, further comprising:

by the processor:

accessing a data set of available substrates;

identifying, from the data set, the smallest substrate on which the two-dimensional layout will fit; and selecting the identified substrate as the substrate from which the package will be cut.

5. The method of claim 1, wherein identifying the ornamental structure comprises:

accessing a data set of candidate ornamental structures, wherein each of the candidate ornamental structures comprises one or more requirements; and for each candidate ornamental structure, determining whether a characteristic of the unused area satisfies the one or more requirements, and only identifying a candidate ornamental structure as the identified ornamental structure if the characteristic satisfies the one or more requirements.

6. The method of claim 5, wherein the one or more requirements comprise a size requirement, and the characteristic comprises a dimension of the unused area that corresponds to the size requirement.

7. The method of claim 6, further comprising dynamically defining a dimension of the ornamental structure based on the dimension of the unused area.

8. The method of claim 1, wherein the identified ornamental structure comprises a ribbon, a detachable coupon, or an ornamental face.

9. A package definition system, comprising:

a data storage facility containing data corresponding to a plurality of ornamental structures;

a processor; and a computer-readable medium containing programming instructions that, when executed, instruct the processor to:

receive a package design file containing data representing a plurality of facets and a plurality of dimensions for a package;

identify, from the package design file, a two-dimensional layout of the package;

identify a first area of a substrate to be used to form a two-dimensional flat of the package;

identify an unused area of the substrate that will not form part of the package;

access the data storage facility and applying one or more rules to identify an ornamental structure that is attachable to a facet of the package and which fits within a portion of the unused area adjacent to the facet; and update the package design file to include the ornamental structure.

10. The system of claim 9, further comprising additional programming instructions that, when executed, instruct the processor to:

receive, via a user interface, a user selection of the ornamental element; and update the package design file to include data that adds the ornamental structure to the package.

11. The system of claim 9, further comprising additional programming instructions that, when executed, instruct the processor to:

determine that one or more characteristics of the package, the ornamental structure, or the substrate satisfy one or more criteria for automatic addition to the package; and automatically, without any requirement for user input, update the package design file to include data that adds the ornamental structure to the package.

12. The system of claim 9, further comprising additional programming instructions that, when executed, instruct the processor to:

access a data set of available substrates;

identify, from the data set, the smallest substrate on which the two-dimensional layout will fit; and select the identified substrate as the substrate from which the package will be cut.

13. The system of claim 9, wherein the programming instructions that, when executed, instruct the processor to identify the ornamental structure comprise instructions to:

access a data set of candidate ornamental structures, wherein each of the candidate ornamental structures comprises one or more requirements; and for each candidate ornamental structure, determine whether a characteristic of the unused area satisfies the one or more requirements, and only identify a candidate ornamental structure as the identified ornamental structure if the characteristic satisfies the one or more requirements.

14. The system of claim 13, wherein:

the one or more requirements comprise a size requirement, and the characteristic comprises a dimension of the unused area that corresponds to the size requirement; and the programming instructions further comprise additional instructions that, when executed, instruct the processor to dynamically define a dimension of the ornamental structure based on the dimension of the unused area.

15. The system of claim 9, further comprising:

a package generation device comprising a print device, cutting device, and creasing device configured to apply a rule set to the package design file and modify the substrate to yield a package flat with the package and its ornamental structure.

16. The system of claim 9, wherein the identified ornamental structure comprises a ribbon, a detachable coupon, or an ornamental face.

17. A method, comprising:

receiving a package design file containing data representing a plurality of facets and a plurality of dimensions for a package;

by a processor, identifying from the package design file, a two-dimensional layout of the package;

by the processor, identifying a first area of a substrate to be used to form a two-dimensional flat of the package;

by the processor, identifying an unused area of the substrate that will not form part of the package;

by the processor, applying one or more rules to identify an ornamental structure that is attachable to a facet of the package and which fits within a portion of the unused area adjacent to the facet; and outputting a representation of the ornamental structure to a user;

receiving, via a user interface, a user selection of the ornamental structure;

by the processor, updating the package design file to include data that adds the ornamental element to the package;

applying, by a package generation device, a rule set to the package design file to generate the two-dimensional flat comprising the package with the ornamental structure.

18. The method of claim 17, further comprising, by the processor accessing a data set of available substrates;

identifying, from the data set, the smallest substrate on which the two-dimensional layout will fit; and selecting the identified substrate as the substrate from which the package will be cut.

* * * * *